US011613281B2

(12) United States Patent
Harris

(10) Patent No.: US 11,613,281 B2
(45) Date of Patent: Mar. 28, 2023

(54) RAILWAY TRUCK ASSEMBLY HAVING COMPRESSIBLE SIDE BEARINGS

(71) Applicant: Amsted Rail Company, Inc., Chicago, IL (US)

(72) Inventor: Zachary B. Harris, Edwardsville, IL (US)

(73) Assignee: Amsted Rail Company, Inc., Chicago, IL (US)

( * ) Notice: Subject to any disclaimer, the term of this patent is extended or adjusted under 35 U.S.C. 154(b) by 311 days.

(21) Appl. No.: 17/079,812

(22) Filed: Oct. 26, 2020

(65) Prior Publication Data

US 2022/0126890 A1 Apr. 28, 2022

(51) Int. Cl.

| | |
|---|---|
| ***B61F 5/14*** | (2006.01) |
| ***B61F 5/30*** | (2006.01) |
| ***B61F 5/12*** | (2006.01) |

(52) U.S. Cl.

CPC ..... *B61F 5/14* (2013.01); *B61F 5/122* (2013.01); *B61F 5/142* (2013.01); *B61F 5/144* (2013.01); *B61F 5/305* (2013.01)

(58) Field of Classification Search

CPC ..... B61F 5/00; B61F 5/02; B61F 5/04; B61F 5/12; B61F 5/122; B61F 5/14; B61F 5/142; B61F 5/144; B61F 5/16; B61F 5/20; B61F 5/24; B61F 5/245

See application file for complete search history.

(56) References Cited

U.S. PATENT DOCUMENTS

| | | | | |
|---|---|---|---|---|
| 1,808,839 | A | 6/1931 | Davis | |
| 3,730,104 | A | 5/1973 | Hood, II | |
| 3,735,711 | A * | 5/1973 | Hassenauer | B61F 5/142 267/3 |
| 3,748,001 | A | 7/1973 | Neumann | |
| 3,762,338 | A | 10/1973 | Dwyer | |
| 3,762,339 | A | 10/1973 | Dwyer | |
| 3,897,737 | A | 8/1975 | Davis | |
| 4,130,066 | A | 12/1978 | Mulcahy | |
| 4,434,720 | A * | 3/1984 | Mulcahy | B61F 5/142 267/152 |
| 4,715,290 | A | 12/1987 | Hood, II | |
| 4,859,089 | A | 8/1989 | Wright | |

(Continued)

FOREIGN PATENT DOCUMENTS

| | | |
|---|---|---|
| RU | 182899 U1 * | 9/2018 |
| WO | WO 2007096655 | 8/2007 |

(Continued)

OTHER PUBLICATIONS

Notification of Transmittal of the International Search Report and the Written Opinion of the International Searching Authority, or the Declaration for PCT/US2021/053877, dated Jan. 28, 2022.

*Primary Examiner* — S. Joseph Morano
*Assistant Examiner* — Cheng Lin
(74) *Attorney, Agent, or Firm* — The Small Patent Law Group LLC; Joseph M. Butscher

(57) ABSTRACT

A side bearing assembly for a truck assembly of a rail vehicle includes a base, a cap moveably coupled to the base, and one or more elastomer springs disposed between the base and the cap. The one or more elastomer springs include a foam having air pockets that are configured be compressed.

21 Claims, 6 Drawing Sheets

(56) References Cited

U.S. PATENT DOCUMENTS

| | | | | |
|---|---|---|---|---|
| 4,998,997 | A * | 3/1991 | Carlston | B61F 5/142 267/141.1 |
| 5,046,866 | A | 9/1991 | Mulcahy | |
| 5,086,707 | A | 2/1992 | Spencer | |
| 5,601,031 | A | 2/1997 | Carlson | |
| 5,806,435 | A | 9/1998 | Pitchford | |
| 6,644,214 | B1 | 11/2003 | Schorr | |
| 7,121,212 | B2 * | 10/2006 | Schorr | B61F 5/14 384/423 |
| 7,174,837 | B2 | 2/2007 | Berg | |
| 7,325,499 | B2 * | 2/2008 | Jensen | B61F 5/142 384/423 |
| 7,503,264 | B2 * | 3/2009 | Mitchell | B61F 5/142 105/199.3 |
| 7,527,003 | B1 | 5/2009 | Schorr | |
| 7,527,131 | B1 | 5/2009 | Wike | |
| 7,546,807 | B2 | 6/2009 | Johnstone | |
| 7,549,379 | B2 * | 6/2009 | Monaco | B61F 5/14 105/199.3 |
| 7,802,524 | B1 | 9/2010 | Gregar | |
| 8,136,457 | B2 | 3/2012 | Sammartino | |
| 8,201,504 | B2 | 6/2012 | O'Donnell | |
| 8,356,558 | B2 | 1/2013 | Jeambey | |
| 8,590,460 | B2 | 11/2013 | Wike | |
| 8,807,050 | B2 | 8/2014 | Aspengen | |
| 8,939,087 | B2 * | 1/2015 | McKisic | B61F 15/20 105/199.3 |
| 8,967,052 | B2 * | 3/2015 | Aspengren | B61F 5/142 105/199.3 |
| 9,555,818 | B1 | 1/2017 | Wike | |
| 62,663,755 | | 4/2018 | Wike | |
| 2008/0173211 | A1 | 7/2008 | Kennedy | |
| 2009/0308276 | A1 | 12/2009 | Aitken | |
| 2012/0291660 | A1 | 11/2012 | Aspengen | |
| 2013/0145956 | A1 | 6/2013 | Sammartino | |
| 2019/0367051 | A1 | 12/2019 | Wike | |
| 2020/0139994 | A1 * | 5/2020 | Harris | B61F 5/14 |

FOREIGN PATENT DOCUMENTS

| | | |
|---|---|---|
| WO | WO 2013090244 | 6/2013 |
| WO | WO 2019/209789 | 10/2019 |

* cited by examiner

RAILWAY TRUCK ASSEMBLY HAVING COMPRESSIBLE SIDE BEARINGS

FIELD OF THE DISCLOSURE

Embodiments of the present disclosure generally relate to truck assemblies for rail vehicles, such as rail cars, and, more particularly, to truck assemblies that include one or more compressible side bearings, which are configured to stabilize the rail vehicles during travel.

BACKGROUND OF THE DISCLOSURE

Rail vehicles travel along railways, which have tracks that include rails. A rail vehicle includes one or more truck assemblies that support one or more car bodies. Each truck assembly includes two side frames and a bolster. Friction shoes are disposed between the bolster and the side frames. The friction shoes are configured to provide damping for suspension.

Freight rail vehicles often include a car body that carries bulk items, finished goods, and the like. The car body includes a center sill that extends under the car body from a first end to an opposite second end. Coupling systems are attached at the ends of the center sill. The coupling systems couple the rail vehicle to adjoining rail vehicles.

Bolsters are proximate to the ends of the center sill. The bolsters extend laterally across and under the car body. The bolsters extend and attach to the center sill from both sides. A center plate is centrally located on the car body bolster and positioned under the center sill.

A truck assembly typically has a centrally-located center plate or bowl. A center plate of the car body typically seats on the center plate or bowl of the truck assembly. A vertical load of the car body is transferred from the center plate to the center bowl or plate of the truck assembly. Typically, the truck assembly is configured to rotate about an interface between the center plates or bowls.

A typical truck assembly also includes side bearings, which are outboard of the center bowl. The side bearings are configured to limit roll of the car body and ensure that the car body does not overturn.

Known side bearings include a compression spring or elastic element to dampen a roll load of the car body against the truck assembly. The side bearings also dampen rotational inertia of the truck assembly, thereby adding stability to the rail vehicle.

However, known side bearings for rail vehicles may create inherent instabilities. While such instabilities have been present and known, they are more pronounced with increased freight capacity, increased operating speeds, and increased stringency of safety standards.

SUMMARY OF THE DISCLOSURE

A need exists for a side bearing that provides increased stability for a rail vehicle. Further, a need exists for a side bearing that provides increased control of roll, yaw, and the like.

With those needs in mind, certain embodiments of the present disclosure provide a side bearing assembly for a truck assembly of a rail vehicle. The side bearing assembly includes a base, a cap moveably coupled to the base, and one or more elastomer springs disposed between the base and the cap. The one or more elastomer springs comprise a foam having air pockets that are configured be compressed. In at least one embodiment, the air pockets form at least half of the one or more elastomer springs.

As an example, the one or more elastomer springs include a head having a first width, and a neck having a second width that is less than the first width. As a further example, the one or more elastomer springs further include a foot having a third width that is greater than the second width.

As an example, the base includes a central stand. The elastomer spring is contained between the cap and the central stand.

As an example, the base include a collar having an alignment rim. The alignment rim extends inwardly toward the cap.

In at least on embodiment, one or more friction modifiers are disposed between a collar of the base and a wall of the cap.

As an example, the cap includes a lower ledge, and the base includes a collar having an upper ridge. The cap is below the upper ridge.

In at least one embodiment, the one or more elastomer springs include a first elastomer spring and a second elastomer spring. As a further example, the first elastomer spring has a first density, and the second elastomer spring has a second density that differs from the first density.

In at least on embodiment, the one or more elastomer springs include one or more indentations.

In at least one embodiment, an alignment plate secures the one or more elastomer springs to the base.

Certain embodiments of the present disclosure provide a method of forming a side bearing assembly for a truck assembly of a rail vehicle. The method includes moveably coupling a cap to a base, and disposing one or more elastomer springs between the base and the cap. The one or more elastomer springs include a foam having air pockets that are configured be compressed.

Certain embodiments of the present disclosure provide a truck assembly that is configured to travel along a track having rails. The truck assembly includes a first side frame, a second side frame, a bolster extending between the first side frame and the second side frame, a first wheel set coupled to the first side frame and the second side frame, a second wheel set coupled to the first side frame and the second side frame, a first side bearing assembly coupled to the bolster, and a second side bearing assembly coupled to the bolster. The first side bearing assembly is mounted on a top surface of the bolster between a bolster center bowl and a first end. The second side bearing assembly is mounted on the top surface of the bolster between the bolster center bowl and a second end. One or both of the first side bearing assembly or the second side bearing assembly may be configured as described herein.

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Certain embodiments of the present disclosure provide a side bearing assembly that includes an elastomer spring used in volumetric compression to dampen the roll energy of a car body. When an elastomer spring is used in volumetric compression, the maximum load the spring can carry is increased, and, at the same time, the hysteresis or energy absorption of the elastomer is also increased substantially. With certain elastomers, the energy absorption of volumetric compression can be at least six times greater than the same elastomer used in free compression.

In at least one embodiment, the elastomer spring is or includes a foam material, such as microcellular urethane within a defined volume or space. In at least one embodiment, the foam is an open-cell foam, in which the cells collapse toward one another during compression. The cells, such as air pockets, within the foam are compressible, which allows for increased, controlled compression of the elastomer spring.

The elastomer spring is configured for volumetric compression. The elastomer spring is disposed within a defined space that constrains or otherwise restricts the elastomer spring from outwardly expanding during compression. Because the elastomer spring includes (for example, is at least in part formed of) a foam material, there is the benefit of greater force with travel because instead of the material compressing, the air voids first compress. For example, if the foam is at least half air (for example, at least half of the foam is formed of air pockets), the material can compress by nearly 50% before the force characteristic starts showing signs of incompressibility.

As described herein, embodiments of the present disclosure provide a side bearing assembly for a truck assembly of a rail vehicle. The side bearing assembly comprises a base, a cap moveably coupled to the base, and at least one elastomer spring disposed retained between the base and the cap. The elastomer spring(s) includes a foam having one or more open cells, such as air pockets that are configured to be compressed. The foam is configured to allow the elastomer spring to compress. For example, the foam includes hundred, thousands, or even millions of open cells.

Figure 1:
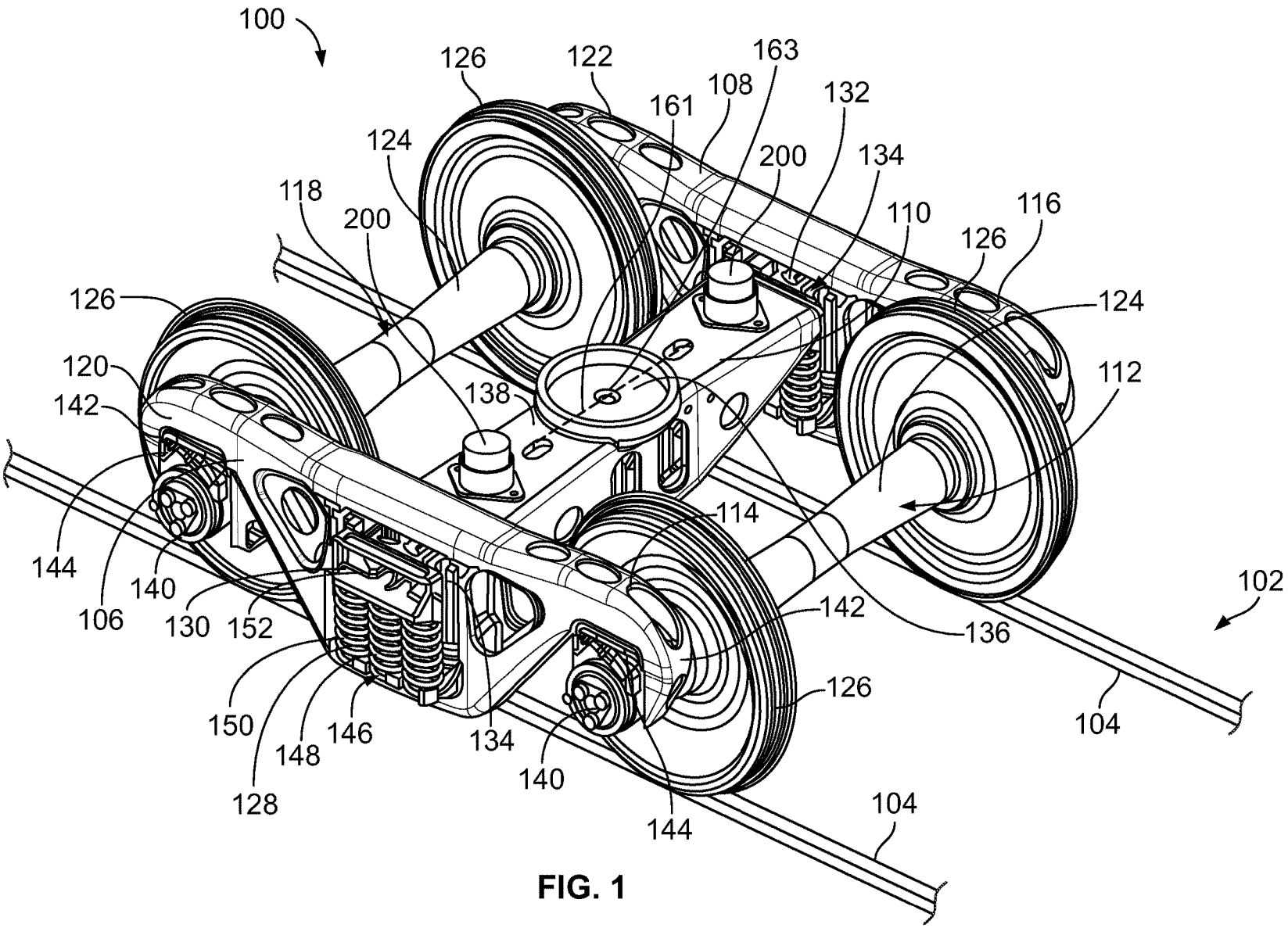
FIG. 1 illustrate a perspective top view of a truck assembly, according to an embodiment of the present disclosure.

FIG. 1 illustrate a perspective top view of a truck assembly 100, according to an embodiment of the present disclosure. The truck assembly 100 is configured to travel along a track 102 having rails 104. The truck assembly 100 includes a first side frame 106 and a second side frame 108, which are spaced apart from one another. A bolster 110 extends between the first side frame 106 and the second side frame 108, and couples the first side frame 106 to the second side frame 108.

A first wheel set 112 is rotatably coupled to first ends 114 and 116 of the first side frame 106 and the second side frame 108, respectively, and a second wheel set 118 is rotatably coupled to second ends 120 and 122 of the first side frame 106 and the second side frame 108, respectively. Each of the first and second wheel sets 112 and 118 includes an axle 124 connected to wheels 126. The wheels 126 are supported on the rails 104 and are configured to travel thereon as the axles 124 rotate in relation to the first side frame 106 and the second side frame 108.

The first and second side frames 106 and 108 include damper systems 128. For example, the damper systems 128 include one or more springs, friction shoes, and the like that are configured to dampen forces exerted into and/or by the truck assembly 100 as the truck assembly 100 travels along the track 102.

The bolster 110 includes ends 130 and 132 (for example a first end 130 and an opposite second end 132), which extend through openings 134 of the side frames 106 and 108. The bolster 110 also includes a bolster center bowl 136 outwardly extending from an upper surface 138. As shown, the bolster center bowl 136 is centrally located on the upper surface 138 of the bolster 110 between the ends 130 and 132.

Ends of the axles 124 are rotatably retained by bearings 140, which are coupled to the side frames 106 and 108. In particular, the wheel sets 112 and 118 are coupled to the side frames 106 and 108 at pedestals 142 of the side frames 106 and 108. The pedestals 142 connect to bearing adapters 144 that connect to the bearings 140.

In at least one embodiment, the damping systems 128 include spring groups 146 supported within the openings 134 of the side frames 106 and 108. The spring groups 146 include load coils 148 and control coils 150. The load coils 148 support the bolster 110 at the ends 130 and 132. The control coils 150 support friction shoes 152.

A first side bearing assembly 200 is mounted on the top surface 138 of the bolster 110 between the bolster center bowl 136 and the end 130. A second side bearing assembly 200 is mounted on the top surface 138 of the bolster 110 between the bolster center bowl 136 and the end 132. The side bearing assemblies 200 may be aligned along a central longitudinal plane 161 of the bolster 110 that passes through a center 163 of the bolster center bowl 136. Each side bearing assembly 200 may be spaced from the center 163 the same distance, but in opposite directions.

Figure 2:
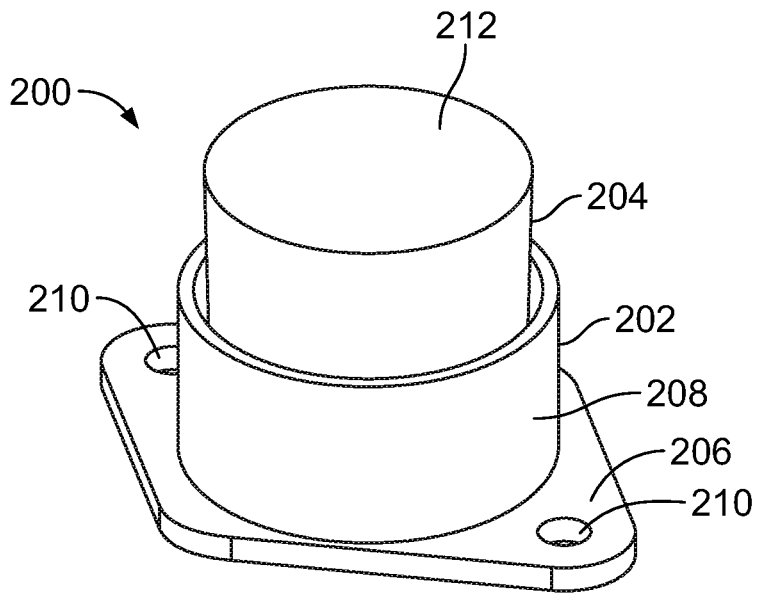
FIG. 2 illustrates a perspective top view of a side bearing, according to an embodiment of the present disclosure.
Figure 3:
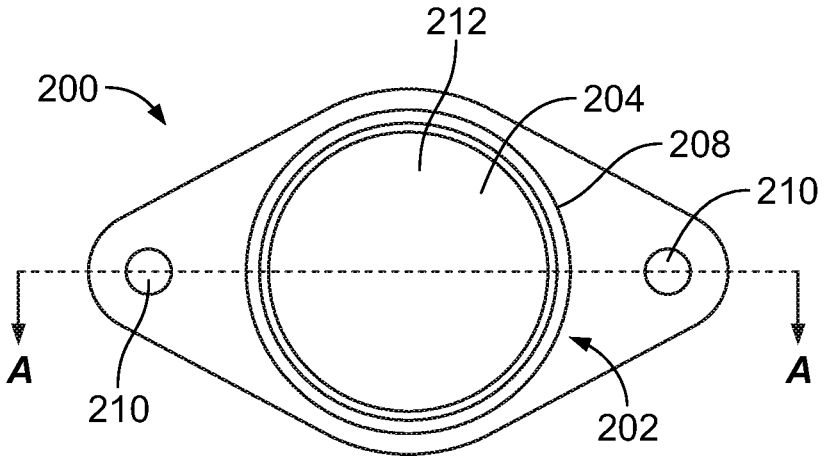
FIG. 3 illustrates a top view of the side bearing of FIG. 2.

FIG. 2 illustrates a perspective top view of a side bearing 200 (such as shown in FIG. 1), according to an embodiment of the present disclosure. FIG. 3 illustrates a top view of the side bearing 200 of FIG. 2. Referring to FIGS. 2 and 3, the side bearing 200 includes a base 202, a cap 204 moveably secured to the base 202, and a compressible elastomer spring (not shown in FIG. 2) retained between the cap 204 and the base 202.

The base 202 includes a mounting flange 206 and a collar 208 (such as a tube) upwardly extending from the mounting flange 206. The mounting flange 206 can include one or more fastener through-holes 210 that are configured to receive and retain fasteners (such as bolts, screws, or the like) that are configured to securely fasten the base 202 to the bolster 110 (shown in FIG. 1). Alternatively, the mounting flange 206 can be secured to the bolster 110 through bonding, welding, adhesives, and/or the like instead of, or in addition to, separate fasteners.

Referring to FIGS. 1-3, the mounting flange 206 is mounted on the top surface 138 of the bolster 110 between the bolster center bowl 136 and the end 130. The side bearing assemblies 200 are configured to limit roll of a car body supported by the truck assembly 100, thereby increasing the stability of the car body and the truck assembly 100, as well as a rail vehicle that includes the car body and the truck assembly 100. A top surface 212 of the cap 204 is configured to abut into the wear plate of the car body. As described herein, the side bearing assemblies 200 include elastomer springs including foam, such as an open cell foam having a plurality of air pockets. For example, the elastomer springs are formed of the foam having the air pockets. The elastomer springs are configured to be compressed. The compression is contained within a defined volume of space.

When a rail vehicle including the truck assembly 100 and a car body supported on the truck assembly 100 travels along the track 102, perturbations of the track 102 are transferred into the rail vehicle in the form of displacement. Displacement of a center of gravity of the car body on the truck assembly 100 creates roll energy, which changes distribution of the weight of the car body and/or the truck assembly 100 on the wheel sets 112 and 118. The center of gravity of a rail vehicle is a point where a weight of the car body and lading react. The weight reacts about the center bowl 136 and the side bearing assemblies 200, which dampen roll forces and prevent overturning.

The side bearing assemblies 200 may be sized and shaped differently. As shown, the collar 208 can be tubular. However, the collar 208 can be shaped differently, such as a block, and the cap 204 can have a different axial cross section than shown. Further, the mounting flange 206 can include more or less fastener through-holes 210 than shown.

Figure 4:
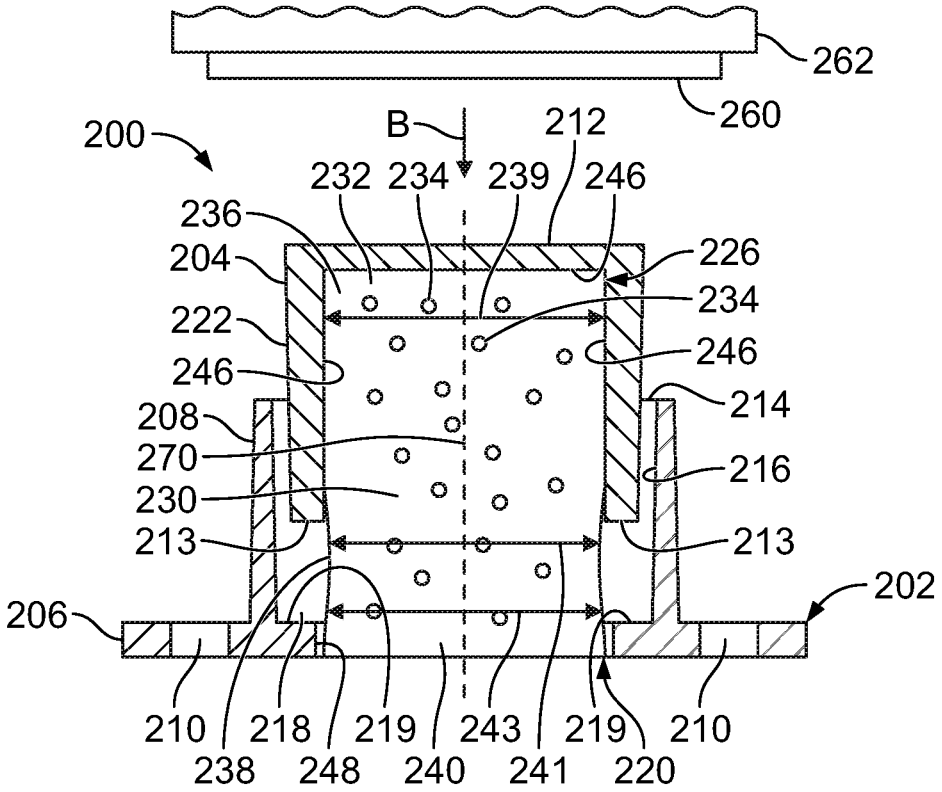
FIG. 4 illustrates a cross-sectional view of the side bearing of FIG. 3 through line A-A of FIG. 3, according to an embodiment of the present disclosure.

FIG. 4 illustrates a cross-sectional view of the side bearing of FIG. 3 through line A-A of FIG. 3, according to an embodiment of the present disclosure. The base 202 includes an internal chamber 214 defined between internal surfaces 216 of the collar 208 and an upper surface 218 of rim 219 of the mounting flange 206. An opening 220 can be formed through the rim 219 of the mounting flange 206.

The cap 204 includes a circumferential or perimeter wall 222 downwardly extending from the top surface 212. The wall 222 can inwardly cant from the top surface 212 to a lower edge 213. A retaining chamber 226 is defined between the top surface 212 and the wall 222.

The elastomer spring 230 is retained between the cap 204 and the base 202. The elastomer spring 230 includes a foam 232 having a plurality of open cells, such as air pockets 234. For example, the elastomer spring 230 is an open-cell foam having the air pockets 234. In at least one embodiment, the air pockets 234 form at least half of the entire body of the elastomer spring 230. Optionally, the air pockets 234 may form less than half of the entire body of the elastomer spring 230.

The elastomer spring 230 includes an hour-glass shape. For example, the elastomer spring 230 includes an expanded head 236 contained within the cap 204 proximate the top surface 212. A width of the elastomer spring 230 decreases from the head 236 to a reduced neck 238. The neck 238 has a reduced diameter or width as compared to the head 236. For example, the width 239 of the head 236 is greater than the width 241 of the neck 238. The width of the elastomer spring 230 can gradually and constantly decrease from the head 236 to the neck 238. A foot 240 of the elastomer spring 230 can be wider than the neck 238. For example, the width 243 of the foot 240 is greater than the width 241. The width 243 may be greater, less than, or equal to the width 239. In at least one embodiment, the foot 240 extends through the opening 220 of the mounting flange 206, and is configured to abut into a top surface of the bolster 110 (shown in FIG. 1). Optionally, the mounting flange 206 may not include the opening 220, in which case the foot 240 abuts into a top surface of the mounting flange 206 below the cap 204.

In at least one embodiment, the width of the elastomer spring 230 can decrease from the head 236 to the foot 240, instead of the foot 240 being wider than the neck 238. The reduced diameter of the neck 238 in relation to the head 236 ensures that the elastomer spring 230 remains contained and constrained below the cap 204 during compression.

As shown in FIG. 4, the elastomer spring 230 is in an at-rest state, such that no force is exerted downwardly into the top surface 212 of the cap in the direction of arrow B. As force is exerted into the top surface 212 in the direction of arrow B, such as by a wear plate of a car body, the air pockets 234 compress and move toward one another, thereby allowing the elastomer spring 230 to compress. The reduced width of the neck 238 prevents the elastomer spring 230 from expanding outwardly between the lower edge 213 of the cap 204 and the rim 219 of the mounting flange 206, thereby allowing the cap 204 to bottom out on the base 202.

The head 236 is retained within the cap 204. As such, the head 236 is constrained from moving out of the cap 204 as the elastomer spring 230 is compressed. The width of the neck 238 is reduced as compared to the head 236, thereby constraining outward expansion. In particular, the neck 238 has a smaller width than the head 236, and, as such, is prevented from outwardly expanding into the spaces between the lower edge 213 of the cap 204 and the rim 219 during compression. Further, the foot 240 is constrained between the rim 219 and a top surface of the bolster 110 (shown in FIG. 1), thereby constraining outward expansion during compression. The rim 219 ensures that the elastomer spring 230 is properly oriented, such as being centered, with respect to the base 202.

The elastomer spring 230 is compressed within the volume defined between the cap 204, the rim 219, and the bolster 110. The compression of the elastomer spring 230 is constrained between the internal surfaces 246 of the cap 204, the interior edge surfaces 248 of the rim 219, and a top surface of the bolster 110. The reduced width of the neck 238 ensures that the elastomer spring 230 does not outwardly expand between the lower edge 213 and the rim 219 during compression.

The elastomer spring 230 is used in volumetric compression to dampen the roll energy of a car body. When an elastomer spring 230 is used in volumetric compression, the maximum load the elastomer spring 230 can carry is increased, and, at the same time, the hysteresis or energy absorption of the elastomer spring 230 is also increased substantially.

In at least one embodiment, the elastomer spring 230 is formed of the foam 232 having the air pockets 234. In at least one example, the foam 232 is a microcellular urethane foam having the air pockets 234. The air pockets 234 provide cells that collapse toward one another during compression.

As noted, a wear plate 260 of a car body 262 contacts the top surface 212 of the cap 204. In a nominal static position, the mass of the car body 262 exerts a force onto the cap 204, and into the elastomer spring 230. Such a compressed nominal height is known as the setup height of a side bearing assembly 200. The force entering the elastomer spring 230 is either reacted on the top surface of the bolster 110 (shown in FIG. 1) or a top surface (such as a stand top) of the base 202. When the elastomer spring 230 is compressed, the outer surfaces of the head 236 of the elastomer spring 230 tend to expand outwardly, but are confined by the cap 204. When the Elastomer Spring 2 expands outwardly (that is, away from a central longitudinal axis 270 of the elastomer spring 230 in an at-rest state), the head 236 exerts a force on the internal surfaces 246 of the cap 204. As the elastomer spring 230 makes contact with the internal surface 246 and continues to compress vertically in the direction of arrow B, a friction force is created by the sliding of the outer surfaces of the head 236 against the internal surfaces 246 of the cap 204. Such frictional force considerably increases the damping capability of the elastomer spring 230 above what can be achieved from free compression alone.

As the car body 262 experiences roll and other dynamic motions, the elastomer spring 230 compresses and expands at opposite rates on either end of the bolster 110 above and below the setup height. When the car body 262 experiences significant roll, the elastomer spring 230 compresses on one side of the bolster 110 until the lower edge 213 of the cap 204 contacts the rim 219, which provides a hard stop on the base 202.

Figure 5:
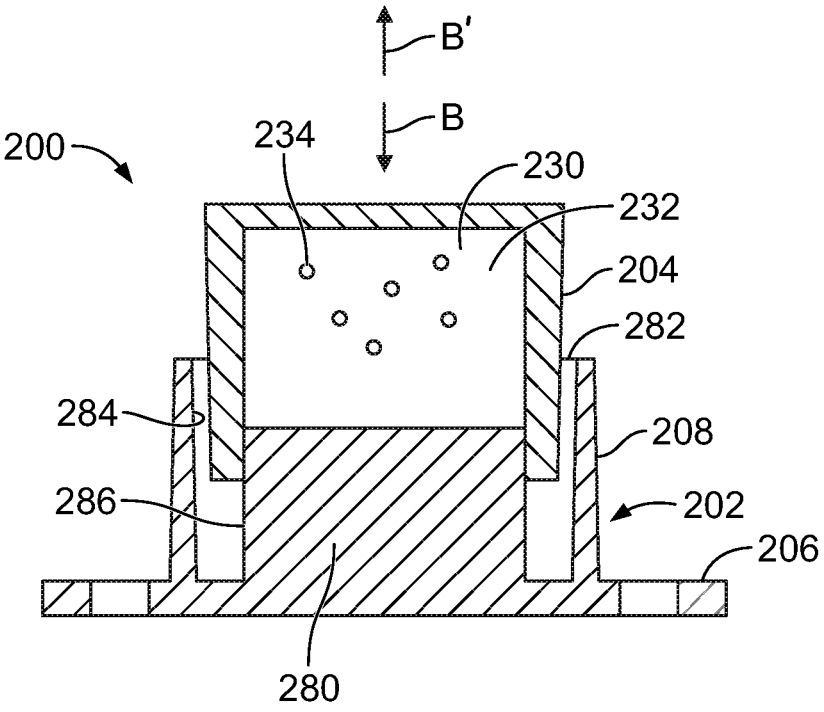
FIG. 5 illustrates a cross-sectional view of the side bearing of FIG. 3 through line A-A of FIG. 3, according to an embodiment of the present disclosure.

FIG. 5 illustrates a cross-sectional view of the side bearing 200 of FIG. 3 through line A-A of FIG. 3, according to an embodiment of the present disclosure. In this embodiment, the elastomer spring 230 is supported on a central stand 280 upwardly extending from the mounting flange 206. A channel 282 is defined between the stand 280 the collar 208. The elastomer spring 230 can be contained between the cap 204 and the central stand 280 between an at-rest position (as shown in FIG. 5) and a fully compressed position. As the cap 204 is moved downwardly in the direction of arrow B, or upwardly in the direction of arrow B', the cap 204 is guided between interior surfaces 284 of collar 208 and outer surfaces 286 of the stand 280.

The elastomer spring 230 may have a block or cylindrical shape. Optionally, the elastomer spring 230 can have an hourglass shape, as shown in FIG. 4.

Figure 6:
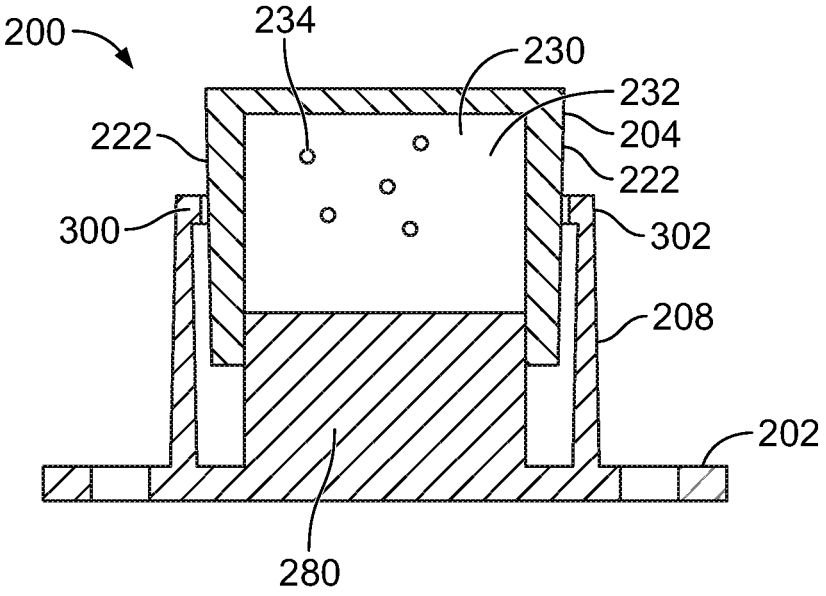
FIG. 6 illustrates a cross-sectional view of the side bearing of FIG. 3 through line A-A of FIG. 3, according to an embodiment of the present disclosure.

FIG. 6 illustrates a cross-sectional view of the side bearing 200 of FIG. 3 through line A-A of FIG. 3, according to an embodiment of the present disclosure. The embodiment shown in FIG. 6 is similar to that shown in FIG. 5, except, along with using the stand 280, an alignment rim 300 extends inwardly from an upper edge 302 of the collar 208. The alignment rim 300 prevents or otherwise reduces the possibility of the cap 204 from rolling about the stand 280 and jamming, such as by reducing the moment created from lateral loads from the car body. The alignment rim 300 extends inwardly from the upper edge 302 of the collar 208 toward an outer surface of the wall 222 of the cap 204. The alignment rim 300 can be used with any of the embodiments described herein, such as the embodiment shown in FIG. 4.

Figure 7:
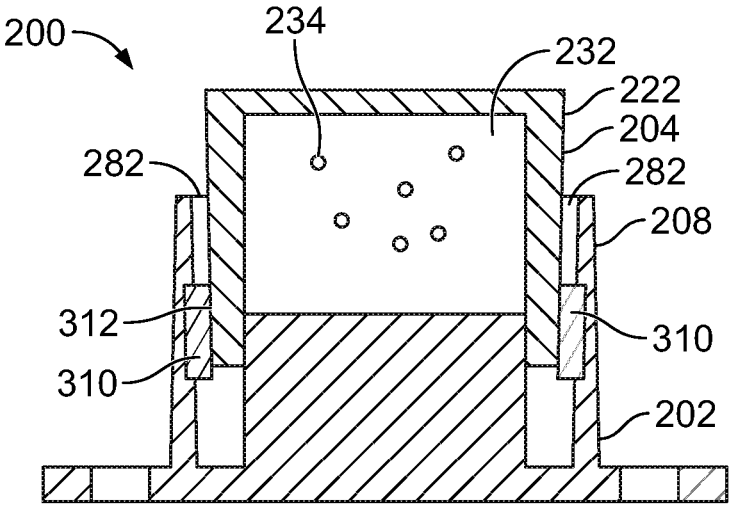
FIG. 7 illustrates a cross-sectional view of the side bearing of FIG. 3 through line A-A of FIG. 3, according to an embodiment of the present disclosure.

FIG. 7 illustrates a cross-sectional view of the side bearing 200 of FIG. 3 through line A-A of FIG. 3, according to an embodiment of the present disclosure. The embodiment shown in FIG. 7 is similar to those shown in FIGS. 5 and 6, except that one or more friction modifiers 310, such as blocks, beams, sheaths, rings, or the like, can be disposed within the channel 282 between the collar 208 and the wall 222 of the cap 204. The friction modifiers 310 align the cap 204 with respect to the base 202, similar to the alignment rim 300 shown and described with respect to FIG. 6. The sliding surfaces 312 of the friction modifiers 310 that contact the wall 222 provide a low coefficient of friction, which allows the cap 204 to smoothly slide, and at the same time reduces the moment created by the lateral loads from the car body. The friction modifiers 310 can be formed of low friction materials, such as polytetrafluoroethylene (PTFE), for example. The friction modifiers 310 can be used with any of the embodiments described herein.

Figure 8:
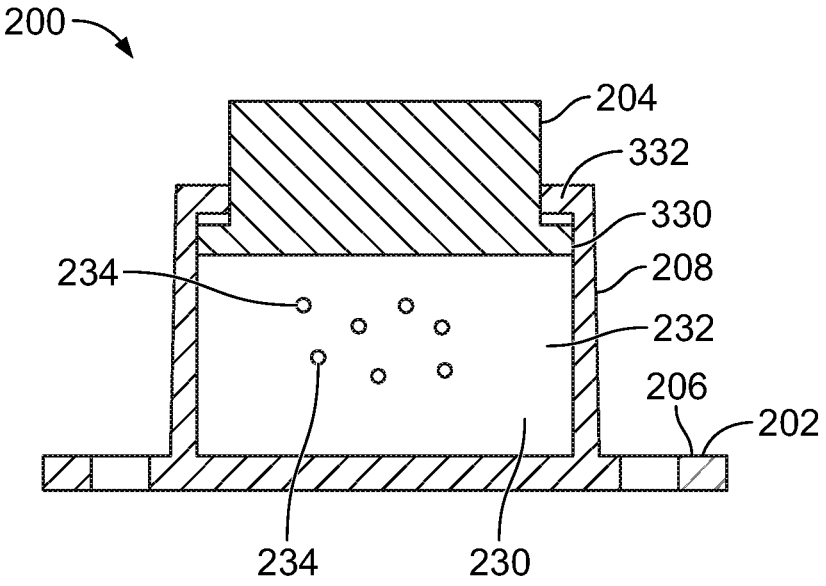
FIG. 8 illustrates a cross-sectional view of the side bearing of FIG. 3 through line A-A of FIG. 3, according to an embodiment of the present disclosure.

FIG. 8 illustrates a cross-sectional view of the side bearing 200 of FIG. 3 through line A-A of FIG. 3, according to an embodiment of the present disclosure. In this embodiment, the cap 204 includes a lower ledge 330 that is below an upper ridge 332 of the collar 208. The upper ridge 332 prevents the cap 204 from ejecting out and away from the collar 208, such as by abutting against the lower ledge 330. The elastomer spring 230 can be fully contained between the mounting flange 206, the collar 208, and the cap 204.

In the embodiment shown in FIG. 8, the cap 204 provides a plunger, which rests on the elastomer spring 230. The upper ridge 332 of the collar 208 provides a plunger stop.

Figure 9:
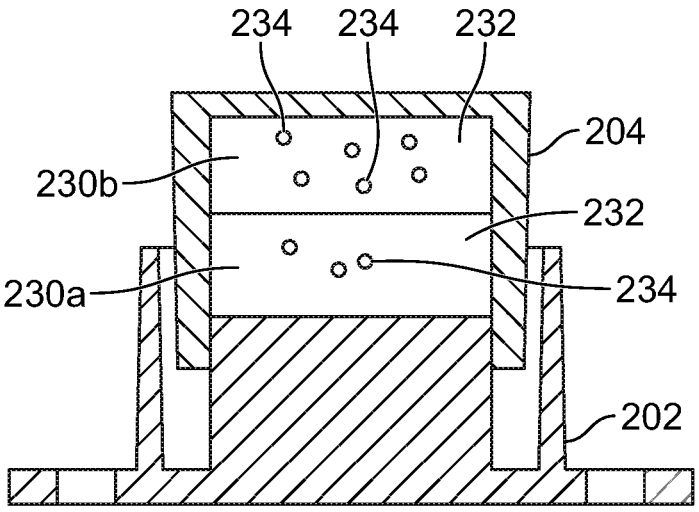
FIG. 9 illustrates a cross-sectional view of the side bearing of FIG. 3 through line A-A of FIG. 3, according to an embodiment of the present disclosure.

FIG. 9 illustrates a cross-sectional view of the side bearing 200 of FIG. 3 through line A-A of FIG. 3, according to an embodiment of the present disclosure. In this embodiment, the side bearing 200 includes a first elastomer spring 230*a* and a second elastomer spring 230*b*, which differs from the first elastomer spring 230*a*. The first elastomer spring 230*a* and the second elastomer spring 230*b* can have different properties. As shown, the second elastomer spring 230*b* can be stacked over the first elastomer spring 230*a*.

The first elastomer spring 230*a* can have a first density and a first stiffness. The second elastomer spring 230*b* can have a second density and a second stiffness. The first and second densities can be different. The first and second stiffnesses can be different. In at least one embodiment, additional elastomer springs can be used, which may also include different densities and stiffnesses.

The first elastomer spring 230*a* can have a density that is higher than the second elastomer spring 230*b*. Optionally, the first elastomer spring 230*a* can have a density that is lower than the second elastomer spring 230*b*. Any of the embodiments described herein can have multiple elastomer springs, which may or may not have different densities and/or stiffnesses.

Figure 10:
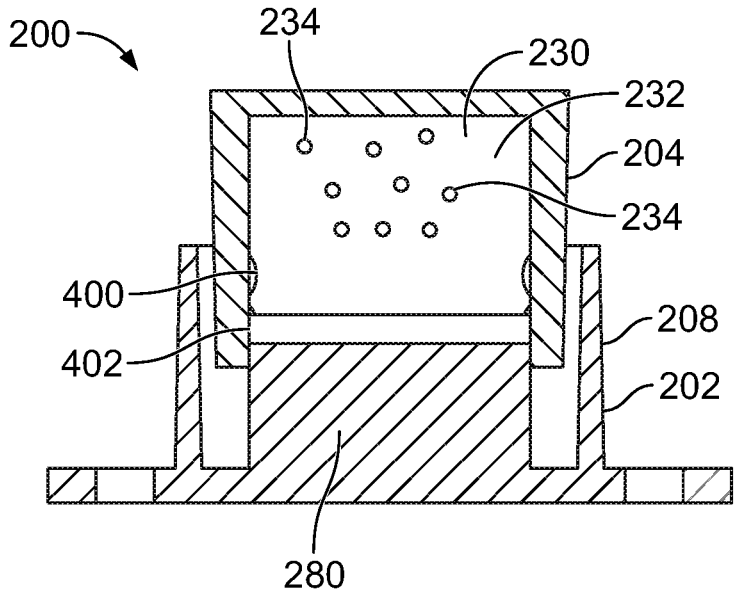
FIG. 10 illustrates a cross-sectional view of the side bearing of FIG. 3 through line A-A of FIG. 3, according to an embodiment of the present disclosure.

FIG. 10 illustrates a cross-sectional view of the side bearing 200 of FIG. 3 through line A-A of FIG. 3, according to an embodiment of the present disclosure. In this embodiment, one or more indentations 400 can be formed into an outer surface of the elastomer spring 230. The indentations 400 can be divots, recessed areas, cut-outs, or the like. The indentations 400 can be a plurality of features, or a contiguous annular structure The indentations 400 aid in further compression of the elastomer spring 230 after the air voids (such as the air pockets 234) have been sufficiently compressed and the material is in volumetric compression. Because the material of the elastomer spring 230 other than the air pockets 234 may be incompressible, the elastomer spring 230 tends to find a void in the side bearing assembly 200 into which it can squeeze into as more load is applied. As shown in FIG. 10, such a void can be the tolerance gap between the cap 204, the stand 280, and the collar 208. The indentations 400 provide reduced material, thereby reducing the possibility of the elastomer spring 230 squeezing into the void.

As shown in FIG. 10, the elastomer spring 230 can be bonded to an alignment plate 402. The alignment plate 402 can be held to a tighter tolerance in order to keep the elastomer spring 230 centered under the cap 204. Optionally, the side bearing assembly 200 may not include the alignment plate 402.

Any of the embodiments described herein can include the alignment plate 402. Further, the elastomer springs 230 of any of the embodiments described herein can include one or more indentations 400.

Figure 11:
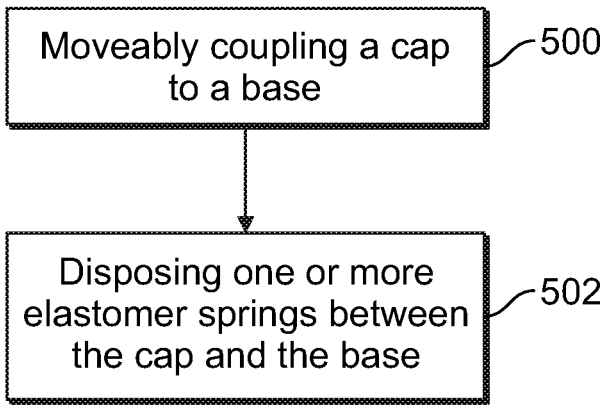
FIG. 11 illustrates a flow chart of a method of forming a side bearing assembly for a truck assembly of a rail vehicle, according to an embodiment of the present disclosure.

FIG. 11 illustrates a flow chart of a method of forming a side bearing assembly for a truck assembly of a rail vehicle, according to an embodiment of the present disclosure. The method includes moveably coupling, at 500, a cap to a base; and disposing, at 502, one or more elastomer springs between the base and the cap. The one or more elastomer springs include a foam having air pockets that are configured be compressed. In at least one embodiment, the method further includes forming at least half of the one or more elastomer springs with the air pockets.

As described herein, embodiments of the present disclosure provide side bearing assemblies that provide increased stability for a rail vehicle. Further, the side bearing assemblies provide increased control of roll, yaw, and the like.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

The invention claimed is:

1. A side bearing assembly for a truck assembly of a rail vehicle, the side bearing assembly comprising:

a base comprising an internal chamber;

a cap moveably coupled to the base, wherein the cap comprises a perimeter wall extending from a top surface, and wherein a retaining chamber is defined between the top surface and the perimeter wall; and one or more elastomer springs disposed between the base and the cap, wherein the one or more elastomer springs comprise at least a portion contained within the retaining chamber between the top surface and the perimeter wall, and wherein the one or more elastomer springs comprise:

a foam having air pockets that are configured to be compressed;

a head having a first width, wherein the at least a portion contained within the retaining chamber includes the head; and a neck having a second width that is less than the first width, wherein the neck is within the internal chamber and outside of the cap, and wherein an intermediate width between the first width and the second width gradually and constantly decreases from the first width to the second width.

2. The side bearing assembly of claim 1, wherein the air pockets form at least half of the one or more elastomer springs.

3. The side bearing assembly of claim 1, wherein the one or more elastomer springs further comprise a foot having a third width that is greater than the second width.

4. The side bearing assembly of claim 1, wherein the base comprises a central stand, and wherein the elastomer spring is contained between the cap and the central stand.

5. The side bearing assembly of claim 1, wherein the base comprises a collar having an alignment rim, and wherein the alignment rim extends inwardly toward the cap.

6. The side bearing assembly of claim 1, further comprising one or more friction modifiers disposed between a collar of the base and a wall of the cap.

7. The side bearing assembly of claim 1, wherein the cap comprises a lower ledge, and wherein the base comprises a collar having an upper ridge, wherein the cap is below the upper ridge.

8. The side bearing assembly of claim 1, wherein the one or more elastomer springs comprise a first elastomer spring and a second elastomer spring.

9. The side bearing assembly of claim 8, wherein the first elastomer spring has a first density, and wherein the second elastomer spring has a second density that differs from the first density.

10. The side bearing assembly of claim 1, wherein the one or more elastomer springs comprise one or more indentations.

11. The side bearing assembly of claim 1, further comprising an alignment plate that secures the one or more elastomer springs to the base.

12. A method of forming a side bearing assembly for a truck assembly of a rail vehicle, the method comprising:

moveably coupling a cap to a base, wherein the cap comprises a perimeter wall extending from a top surface, wherein a retaining chamber is defined between the top surface and the perimeter wall, and wherein the base comprises an internal chamber; and disposing one or more elastomer springs between the base and the cap, at least a portion of the one or more elastomer springs being contained within the retaining chamber between the top surface and the perimeter wall, wherein the one or more elastomer springs comprise:

a foam having air pockets that are configured to be compressed;

a head having a first width, wherein the at least a portion contained within the retaining chamber includes the head; and a neck having a second width that is less than the first width, wherein the neck is within the internal chamber and outside of the cap, and wherein an intermediate width between the first width and the second width gradually and constantly decreases from the first width to the second width.

13. The method of claim 12, further comprising forming at least half of the one or more elastomer springs with the air pockets.

14. A truck assembly that is configured to travel along a track having rails, the truck assembly comprising:

a first side frame;

a second side frame;

a bolster extending between the first side frame and the second side frame;

a first wheel set coupled to the first side frame and the second side frame;

a second wheel set coupled to the first side frame and the second side frame;

a first side bearing assembly coupled to the bolster; and a second side bearing assembly coupled to the bolster, wherein the first side bearing assembly is mounted on a top surface of the bolster between a bolster center bowl and a first end, and wherein the second side bearing assembly is mounted on the top surface of the bolster between the bolster center bowl and a second end, wherein each of the first side bearing assembly and the second side bearing assembly comprises:

a base comprising an internal chamber;

a cap moveably coupled to the base, wherein the cap comprises a perimeter wall extending from a top surface, and wherein a retaining chamber is defined between the top surface and the perimeter wall; and one or more elastomer springs disposed between the base and the cap, wherein the one or more elastomer springs comprise at least a portion contained within the retaining chamber between the top surface and the perimeter wall, and wherein the one or more elastomer springs comprise:

a foam having air pockets that are configured to be compressed;

a head having a first width, wherein the at least a portion contained within the retaining chamber includes the head; and a neck having a second width that is less than the first width, wherein the neck is within the internal chamber and outside of the cap, and wherein an intermediate width between the first width and the second width gradually and constantly decreases from the first width to the second width.

15. The truck assembly of claim 14, wherein the air pockets form at least half of the one or more elastomer springs.

16. The truck assembly of claim 14, wherein the base comprises a collar having an alignment rim, and wherein the alignment rim extends inwardly toward the cap.

17. The truck assembly of claim 14, wherein the each of the first side bearing assembly and the second side bearing assembly further comprises one or more friction modifiers disposed between a collar of the base and a wall of the cap.

18. The truck assembly of claim 14, wherein the cap comprises a lower ledge, and wherein the base comprises a collar having an upper ridge, wherein the cap is below the upper ridge.

19. The truck assembly of claim 14, wherein the one or more elastomer springs comprise a first elastomer spring and a second elastomer spring, wherein the first elastomer spring has a first density, and wherein the second elastomer spring has a second density that differs from the first density.

20. The truck assembly of claim 14, wherein the one or more elastomer springs comprise one or more indentations.

21. The truck assembly of claim 14, wherein the one or more elastomer springs further comprise a foot having a third width that is greater than the second width.

* * * * *